US008227674B2

(12) United States Patent
Brown

(10) Patent No.: US 8,227,674 B2
(45) Date of Patent: Jul. 24, 2012

(54) APPARATUS FOR ASSEMBLING AND REGULATING A GRAND PIANO ACTION

(75) Inventor: Christopher Brown, Littleton, MA (US)

(73) Assignee: Christopher Brown, Littleton, MA (US)

( * ) Notice: Subject to any disclaimer, the term of this patent is extended or adjusted under 35 U.S.C. 154(b) by 60 days.

(21) Appl. No.: 12/907,274

(22) Filed: Oct. 19, 2010

(65) Prior Publication Data

US 2011/0094364 A1 Apr. 28, 2011

Related U.S. Application Data

(60) Provisional application No. 61/255,156, filed on Oct. 27, 2009.

(51) Int. Cl.
*G10C 3/18* (2006.01)

(52) U.S. Cl. ..... 84/239

(58) Field of Classification Search ..... 84/239
See application file for complete search history.

(56) References Cited

U.S. PATENT DOCUMENTS 2,974,216 A * 3/1961 Inoue ..... 219/69.12
3,072,005 A * 1/1963 Corwin et al. ..... 84/174
3,262,195 A * 7/1966 Andersen et al. ..... 29/411
3,538,958 A * 11/1970 Andersen et al. ..... 140/1

OTHER PUBLICATIONS

Schaff Piano Supply Company catalog, copyright 2012, Technician's Tools, pp. 54-55, web page, http://www.schaffpiano.com/catalog/technicians_tools.pdf.

Schaff Piano Supply Company catalog, copyright 2012, Jaras Tools for Precision Craftsmen, p. 70, web page, http://www.schaffpiano.com/catalog/technicians_tools.pdf.

* cited by examiner

*Primary Examiner* — Jianchun Qin
(74) *Attorney, Agent, or Firm* — Smith Moore Leatherwood LLP; Philip P. McCann

(57) ABSTRACT

A practical means to position and adjust the parts of a grand piano's action outside of the piano to fit and play properly, precisely, and as expected in the piano. A custom keybed supports the action as supported in the piano and secures its position. A regulating rack holds one or more reference edges above the action to delineate strike position (the location of hammer-to-string contact in the piano) and those distances from strike required for regulating. It also records hammer spacing at strike. A hammer squaring platform allows a shank traveler and hammer square to set up the hammers to address their strings vertically. And a string height gage assembly, including gage, sliding base, and rail, measures and records strike position in the piano to accurately set up the regulating rack's reference edges.

12 Claims, 14 Drawing Sheets

APPARATUS FOR ASSEMBLING AND REGULATING A GRAND PIANO ACTION

CROSS-REFERENCE TO RELATED APPLICATIONS

This application claims the benefit of priority to U.S. Provisional patent application No. 61/255,156, filed Oct. 27, 2009, which is herein incorporated by reference.

BACKGROUND OF THE INVENTION

The present invention relates to piano regulation and, more particularly, to an apparatus that allows grand piano actions to be assembled and regulated on a benchtop and then fit back into their grand pianos exactly as expected.

When piano technicians, manufacturers, or rebuilders wish to try out parts for a grand piano action, assemble an action, take apart and reassemble an action, or regulate an action, it is useful, but awkward and difficult, to accurately record, store and display the scale of a grand piano, including both hammer spacing and string heights for all sections at once.

Grand piano actions are particularly difficult to work on and have this work done correctly. This is partly because the actions live under the piano's pinblock, where lighting is bad, access is extremely limited, and adequate sightlines are not available. The technician often depends on symptoms, educated guesses and trial-and-error work-arounds to execute the subtleties of work on grand piano actions.

Although good hammer-to-string fit is the foundation for good tone (and bad hammer-to-string fit undermines it), technicians are often faced with unsatisfactory compromises in order to achieve it. Distorting string level, misshaping hammers, and adjusting travel or squareness of hammers without really knowing where the ideal should be are frustrating choices to the earnest technician. At the end of the job, inconsistent outcomes can generate the need for voicing measures that won't work as well as hoped because they don't correct the underlying inaccuracy.

Another hard-to-control aspect of grand action work is what happens after strike. Properly adjusting verticality, particularly in hammer travel and strike, maximizes stability in the bounce. Parts that travel straight up and bounce straight back improve both repetition and power. Repeated notes are easier to control if the hammers aren't bounced out of alignment. The stress and friction in centers pulling hammers back into alignment drain power and increase wear, and the inconsistency of hammers in varying degrees of compliance erodes control and undermines voicing.

As can be seen, there is a need for an apparatus that allows grand piano actions to be assembled and regulated on a benchtop and then fit back into their pianos exactly as expected. Traditional methods have depended on important references that are imprecise and, in particular, fail to match the effective surface of the benchtop to the surface of the piano's keybed.

SUMMARY OF THE INVENTION

In one aspect of the present invention, a regulation station for a grand piano action comprises a regulating rack having a first regulating rack leg slidably attached to a first rigid track; a second regulating rack leg slidably attached to a second rigid track; and a template adapted to span between the first regulating rack leg and the second regulating rack leg, the template providing a representation of the strings of a grand piano along its strike line.

In another aspect of the present invention, a regulation station comprises a custom keybed adapted to secure a grand piano keybed outside of a grand piano, the custom keybed having a front rail and a rear rail spanning a distance between two brackets; a balance rail running parallel to and in between the front and rear rails; a first rigid track and a second rigid track mounted on these rails and approximately perpendicular to them, tying them together in fixed relationship and leveling them into the same plane. These three rails are adjustable to match the configuration of the three rails of a grand piano action's keyframe, with the goal of supporting them out of the piano in the same disposition as when supported in the piano by the grand piano's keybed.

In a further aspect of the present invention, a method for reproducing the correct position of the strings along the strike line outside of a grand piano comprises placing a straight rail inside the grand piano, the rail running along the grand piano keybed; measuring string heights inside the grand piano with a gage that is positioned along the rail; creating a template of the string heights relative to the straight rail; removing the rail and gage from the grand piano; and positioning the template relative to the removed grand piano action on the benchtop using the straight rail and string height gage to set up the template to mimic the string heights measured inside the grand piano.

In a fourth aspect of the present invention, a regulation station comprises a platform that is adjustable to support the hammers of a grand piano action in strike position with a surface adjustable to be parallel to the horizontal plane of the action (what would be parallel to the keybed in the grand piano) from which surface a hammer square may provide reference to true the verticality of each hammer at strike and from which surface a shank traveler may provide precise reference to vertically travel each hammer on its shank between rest position and strike position.

These and other features, aspects and advantages of the present invention will become better understood with reference to the following drawings, description and claims.

DETAILED DESCRIPTION OF THE INVENTION

Figure 1:
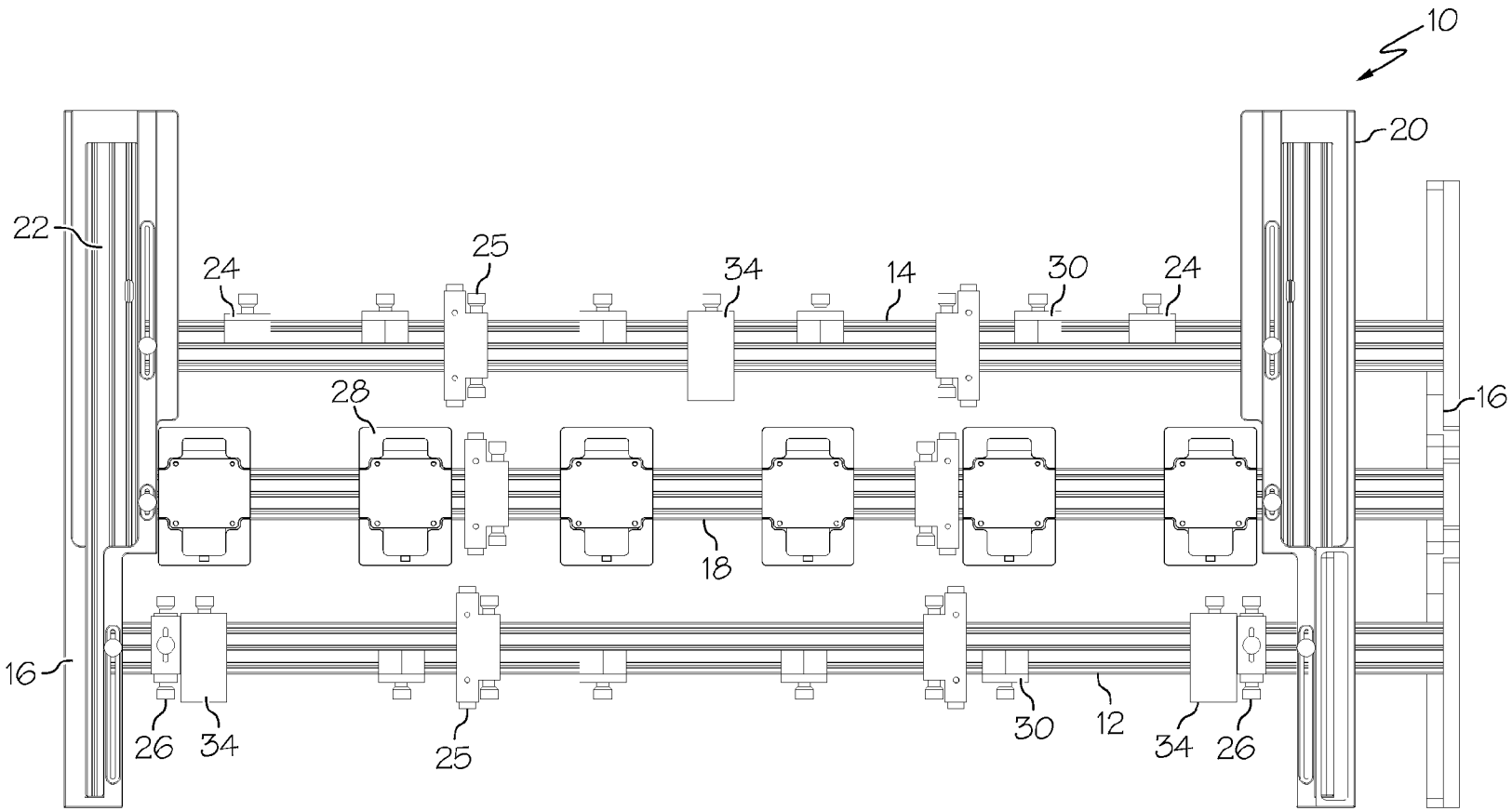
FIG. 1 is a top view of a custom keybed assembly according to an embodiment of the present invention.

The following detailed description is of the best currently contemplated modes of carrying out exemplary embodiments of the invention. The description is not to be taken in a limiting sense, but is made merely for the purpose of illustrating the general principles of the invention, since the scope of the invention is best defined by the appended claims.

Various inventive features are described below that can each be used independently of one another or in combination with other features.

Broadly, an embodiment of the present invention provides a regulation station for creating a practical environment for assembling and regulating a grand piano action. This combination of tools may be used to provide clear and precise references for measuring, aligning, and squaring the parts of the action. A custom keybed supports and positions the action. A regulating rack carries a whole action template or a segmented template, which represents the strings of the grand piano along the strike line, otherwise known as "strike". A hammer squaring platform allows a shank traveler and a hammer square to set up the hammers to address their strings vertically. A string height gage assembly, including a string height gage, sliding base and string height gage rail, measures for the template and sets the template up for use in the regulation station. The regulation station may allow grand piano actions to be assembled and regulated on a benchtop and then fit back into their pianos exactly as expected.

The regulation station suite of tools allows the action to come accurately out of the grand piano onto the benchtop where access, light and sightlines improve immeasurably, where conditions can be ergonomically favorable rather than challenging, and where analysis, sampling, and implementation can proceed under one same stable set-up, so that the final result is conceived, predicted, and accomplished as a matter of procedure, skill, and discipline. In other words, the tools of the present invention help piano technicians apply their professional tradecraft less impeded. A great difficulty for technicians pulling a grand piano action out onto the bench for service is the lack of adequate references once on the bench. The tools of the present invention translate how the action sits in the piano for work on the bench and provide the essential indices of keybed, action stop, and strike (line and height), so that work done on the bench performs as expected in the piano. In particular, the tools of the present invention provide references to vertical (the action relative to the keybed) that are easy to see and accurate. If the hammer travels vertically to the string and arrives vertical at strike, when the hammer is fit to the strings, the result is strings that are parallel to the keybed (which provides a real soft pedal, maintaining hammer fit at any increment) and a hammer travel that moves straight up to strike its strings and then bounces straight back down. With the precise referencing that the tools of the present invention offer, power, repetition, and tone are maximized.

Figure 2:
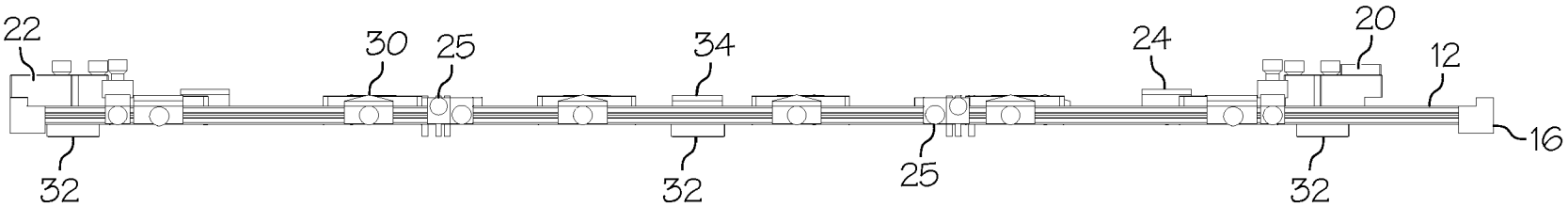
FIG. 2 is a front view of the custom keybed assembly of FIG. 1.
Figure 3:
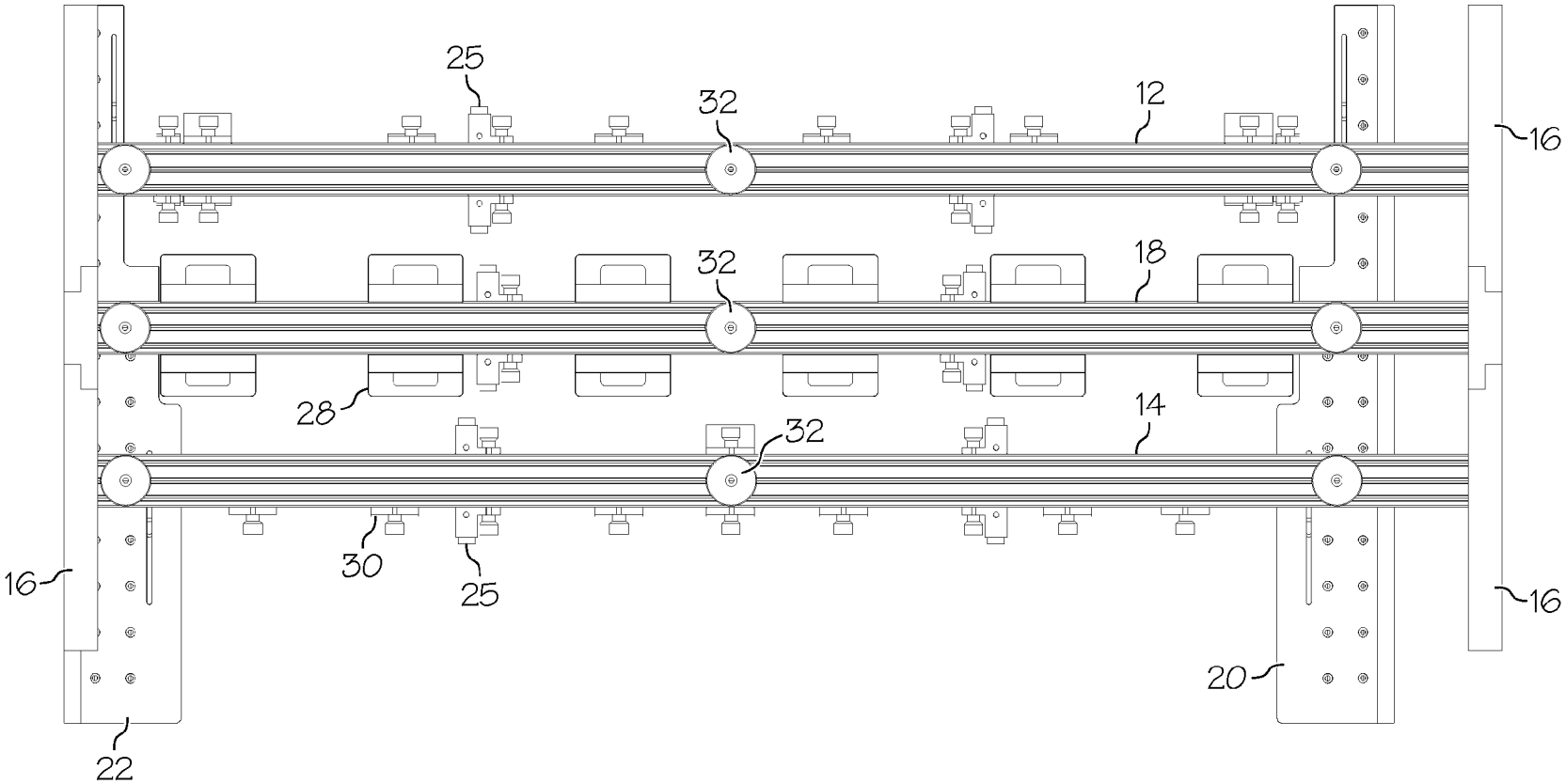
FIG. 3 is a bottom view of the custom keybed assembly of FIG. 1.

Referring to FIGS. 1 through 3, there is shown a custom keybed 10 adapted to position and support the grand piano action (not shown) in a manner effectively the same as how it is supported by the grand piano's keybed and with the same relationships to strike. In some embodiments, the custom keybed 10 may position and support the grand piano action exactly as it is supported by the grand piano's keybed. A front rail 12 and a rear rail 14 may span a distance between two brackets 16. The rails 12, 14 may run substantially parallel to each other. A central rail 18 (also referred to as a balance rail 18) may run parallel to and in between the front and rear rails 12, 14. The balance rail 18 may also be attached to the brackets 16.

Figure 14:
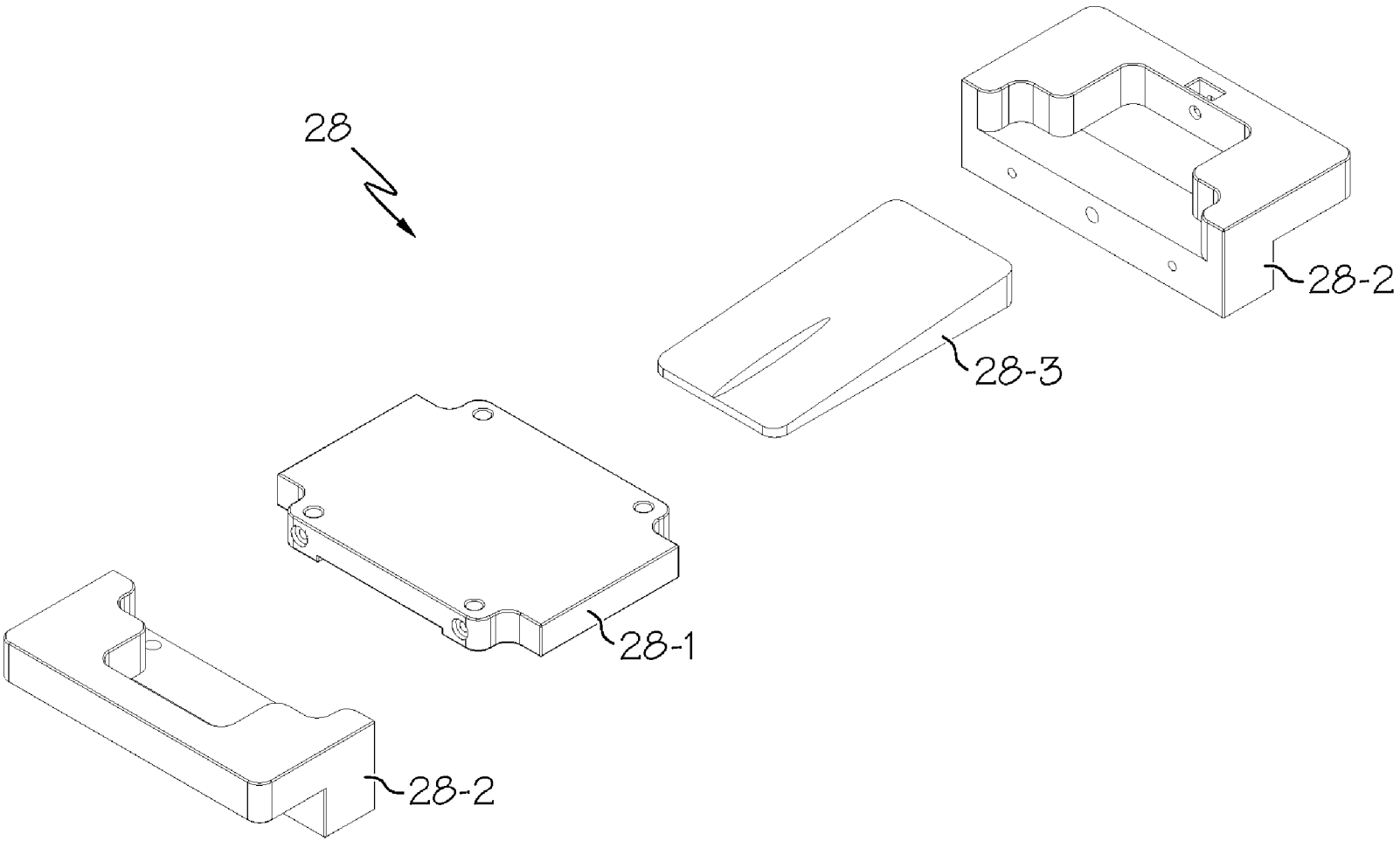
FIG. 14 is an exploded view of a leveling block according to an embodiment of the present invention.

A first rigid track 20 and a second rigid track 22 may be mounted on the rails 12, 14, 18. Keyframe stops 24 may be disposed on the rear rail 14. Holddowns 26 may be disposed on the front rail 12. The keyframe stops 24, the holddowns 26 and the rigid tracks 20, 22 may fix the position of the action on the custom keybed 10. The holddowns 26 may function similarly to conventional cheekblocks (not shown). A plurality of front and rear rail bedding blocks 30 may support the front and back rails of the keyframe. A plurality of leveling blocks 28 (see FIG. 14) may be disposed on the balance rail 18. These leveling blocks 28 may be adjustable when the keys are in the action allowing fine adjustment of the custom keybed's support of the action when the action is fully assembled. Alternatively, a simpler form of leveling blocks 34 may be used in place of leveling blocks 28, providing support for the keyframe's balance studs to fine tune the grand piano's balance rail fit. Either way, this process employs key dip as the index. In some embodiments, the leveling blocks 28 may include a leveler top 28-1, whose underside contains an inclined plane (not visible), disposed between a pair of leveler brackets 28-2. A wedge 28-3, whose underside is flat and parallel to the rail and whose topside is an inclined plane that is the complement of the leveler top's 28-1 inclined plane, may be positioned under the leveler top 28-1 and may be movable lengthwise, thereby providing height adjustment to the leveler top 28-1.

Figure 10:
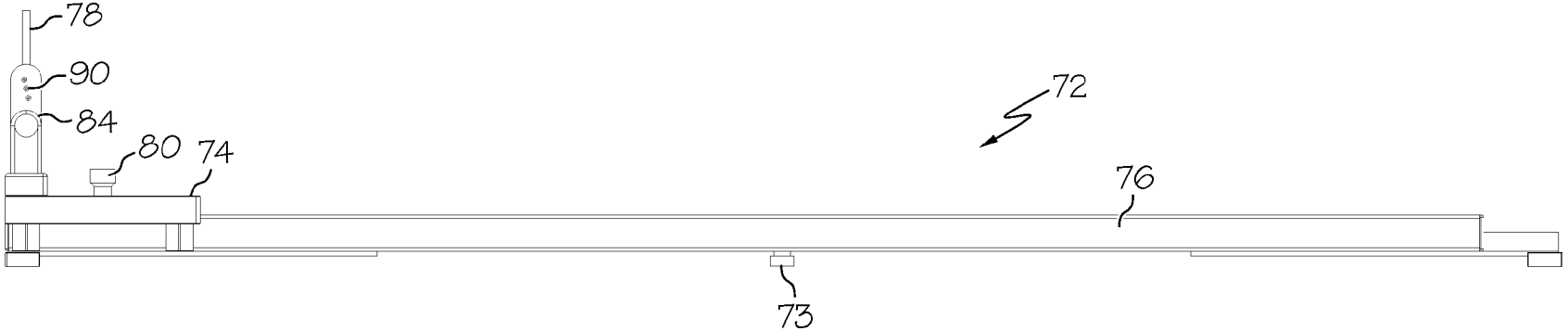
FIG. 10 is a front view of the string height gage assembly, separated from the mounted regulating rack of FIG. 8.
Figure 11:
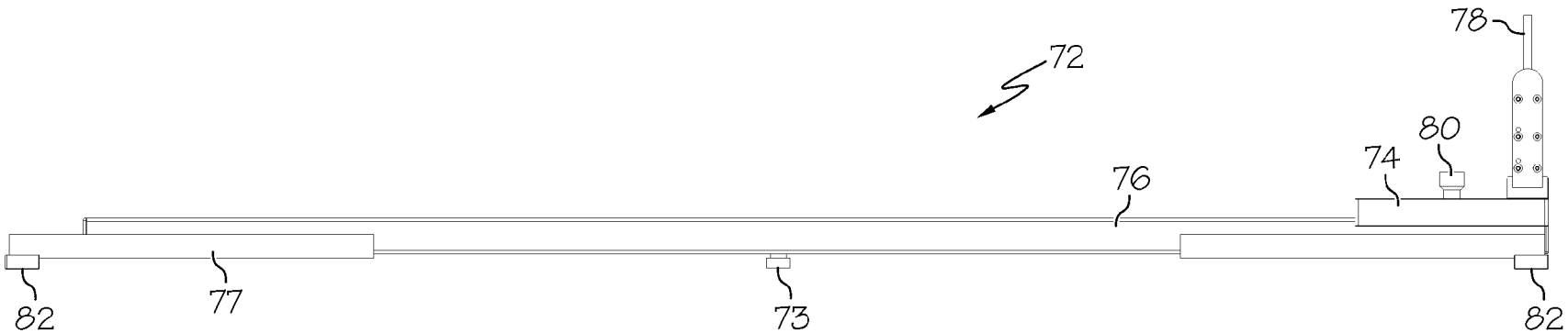
FIG. 11 is a back view of the string height gage assembly of FIG. 10.

A plurality of adjustable levelers 32 may be disposed under the rails 12, 14, 18 to connect the custom keybed 10 to a benchtop (not shown). A rail stabilizer 25, a device that drops a rod either side of the rail onto the benchtop and secures it with a toggle thumb screw, may be employed between levelers to both better connect the custom keybed to the benchtop and to prevent the rail from twisting. A leveling block 34 may be disposed at each end of the front rail 12 to fine adjust the support of that rail and another may be placed on the back rail 14 of the custom keybed 10 to be contacted by a thumb screw 73 supporting the center of the string height gage's straight rail 76 (FIGS. 10 and 11) to keep it from deflecting when setting up segmented template sections.

Referring to FIGS. 4 through 7, the custom keybed 10 may support a regulating rack 36. More specifically, the regulating rack 36 may fit onto and slide along the rigid tracks 20, 22. Regulating rack positioning stops 38 may be disposed on the rigid tracks 20, 22 to provide a stop for the sliding regulating rack 36. The regulating rack 36 may be moved into and out of position depending on the technician's need during action regulation, assembly or the like.

A template 40 may be supported by the regulating rack 36. The template may mount onto a template rail 42 with a plurality of thumb screws 44. A template rail stop collar 46 may secure the strike position of the template rail 42 on a regulating rack leg 45. The regulating rack legs 45 may attach to the rigid tracks 20, 22 via regulating rack feet 47 and regulating rack slippers 49. Template height indicators 48 may provide a visual representation of the template 40 on the template rail 42 at strike position. The regulating rack 36 may include a handle 50 for moving the regulating rack 36 to and from the custom keybed 10 and for storing it by suspending it by the handle.

The regulating rack 36 may be used to hold the template 40 with stability in the correct position, first for clearly referencing strike relative to the action, but then also for providing let-off, hammer line, and other implementations of the strike profile at fixed heights relative to the action useful for set-up and regulation. These references need to be provided accurately in the air above the action, accurately both vertically and horizontally and precisely relating to their counterparts in the piano. Traditional let-off racks fall short of the necessary stability and both they and traditional factory sectional racks lack the combination of flexibility, stability, and ease of adjustment of the regulating rack 36.

The template 40 may be a one-piece template (also referred to as a whole action template), as shown, or may be composed of several pieces that may be fixed side by side on the template rail to form the template 40 (referred to as a segmented template). The bottom edge 52 of the template 40 represents the profile of string heights along the strike line in the piano. The spacing (or "scale") of the hammers is recorded along the bottom edge 52.

Still referring to FIGS. 4 through 7, a squaring platform 54 may take the plane of the overall action (the plane of the keybed translated into a flat surface) and raise it to useful heights (for example, a height that just clears the backchecks) out on the benchtop relative to the action. This reference for the horizontal may be used for a shank traveler 56 and a hammer square 58, providing accurate vertical referencing for traveling the hammer shanks and squaring the hammers to be vertical as they strike the strings. Truing the parts to vertical maximizes their stability, power, repetition, and the tone they are capable of producing by way of strings, bridges, and the soundboard.

From the squaring platform 54, the shank traveler 56 may reach over the backchecks and the hammers with a clear vertical reference 68 for traveling the hammershanks. On the squaring platform's sliding top 60, the hammer square 58 may provide a clear vertical reference for squaring each hammer supported at strike under its shank (since the tails may be variable in length). With one pass, first traveling, then squaring, then spacing, the hammer part of the action can be made nearly perfect. A quick second pass touch-up may perfect it.

A squaring platform template 62 may be mounted on the front of the sliding top 60 to support the hammers by their shanks (instead of the sliding top supporting the hammers directly by tails that may be of variable lengths) and both may be supported on the squaring platform rail by a pair of adjustable brackets 64 that may adjust the height of the sliding top and move from side to side along a squaring platform tray 66. The squaring platform tray 66 may span between the rigid tracks 20, 22. Both the squaring platform tray 66 and the squaring platform 54 may be leveled side to side and front to back relative to the action with use of a small set-up square 68 and a large set-up square 70. Alternatively, a digital leveling device may be employed. The object of the leveling is to make the sliding top 60 of the squaring platform 54 parallel to the horizontal plane of the action as supported by the custom keybed. In dedicated versions of the regulation station, no squaring platform tray is needed. The sliding top 60 may ride on a squaring platform 54 that spans the entire action and custom keybed. The dedicated version of the squaring platform, positioned vertically (as is the portable version) with the adjustable brackets 64 at either end, slides into position and back out of the way front to back on rails either side of the custom keybed (note FIGS. 14 and 15).

Figure 8:
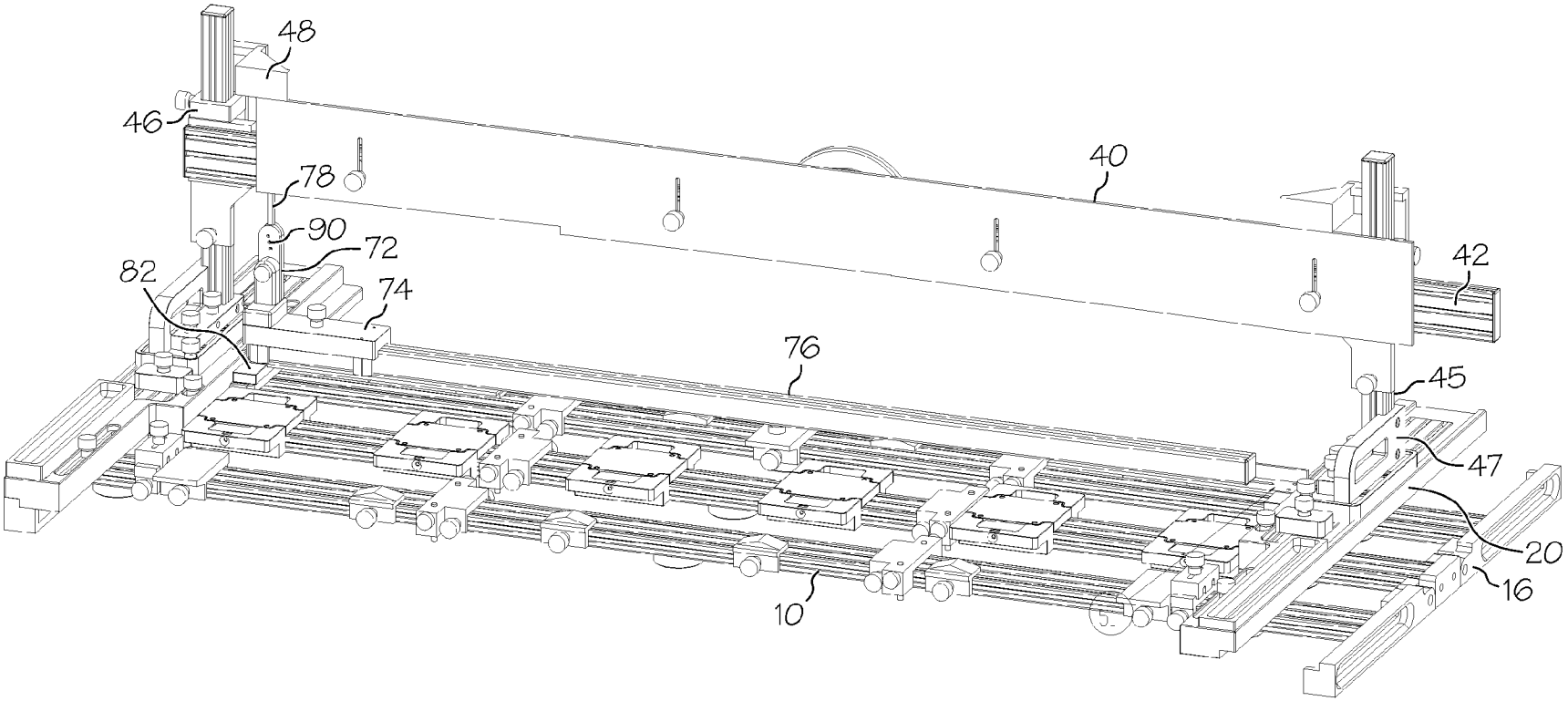
FIG. 8 is perspective view of the mounted regulating rack of FIG. 4 with a string height gage assembly, according to an embodiment of the present invention.
Figure 9:
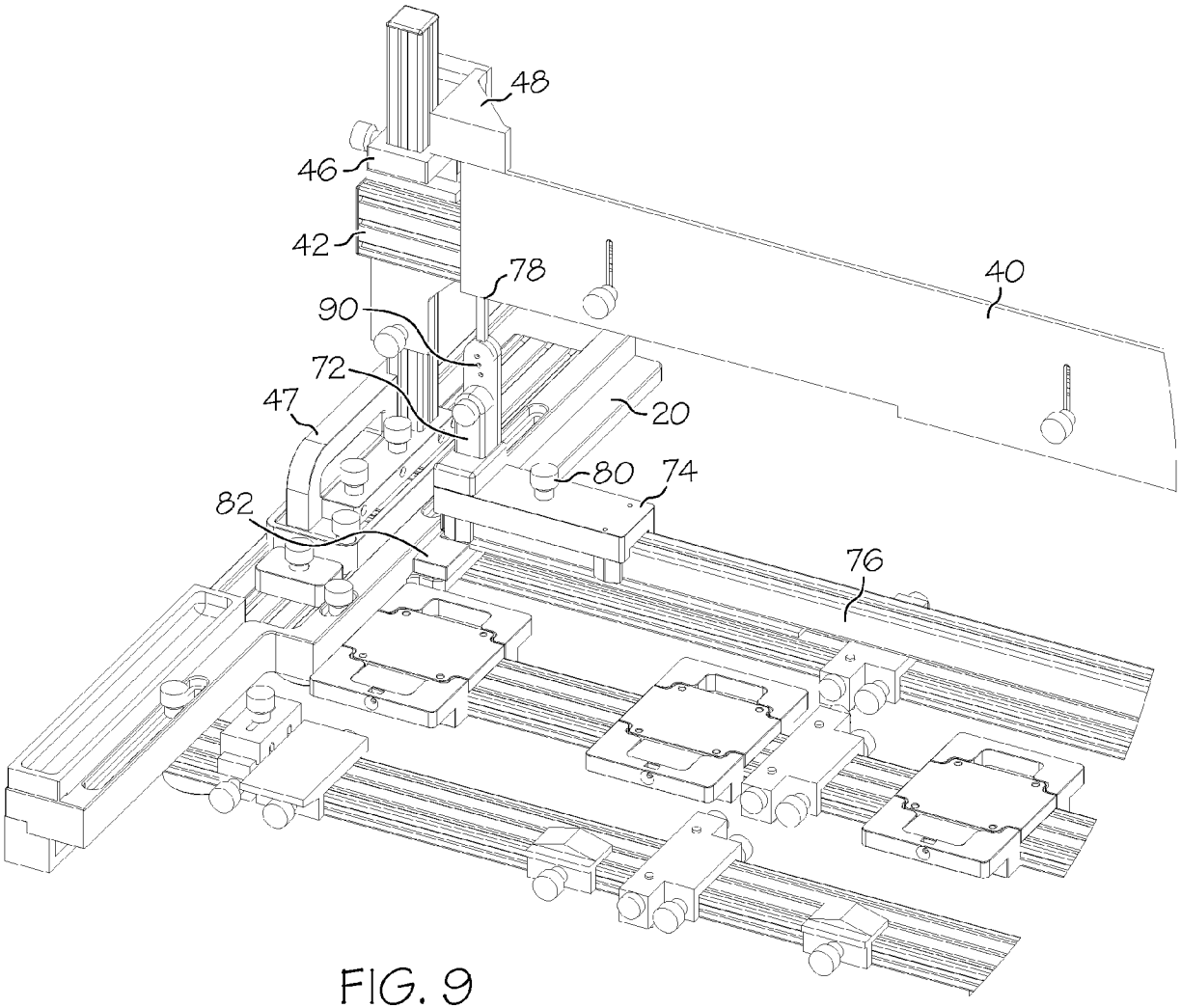
FIG. 9 is a close-up perspective view of the mounted regulating rack of FIG. 8.

Referring now to FIGS. 8 through 13, a string height gage 72 may be used to take measurements in the piano from a base 74 that may slide along a straight rail 76 positioned on the keybed so that the front edge of a plunger 78 follows the strike line. The plunger 78 may be ⅜" square and flat ended. This reference to a straight, horizontal line (from the straight rail 76) may allow a CNC router to accurately cut a profile for the template 40. The gage 72 may then be used to set up the template 40 on the regulating rack 36. For whole action templates (as shown in FIG. 8, for example), only two measurements, one for the lowest note and one for the highest note, may provide accurate information for the entire action.

The base 74 of the gage 72 may include a knob 80 that may lock the base 74 in position on the straight rail 76 by tightening on a stud with a nut on its end captured by a track in the straight rail. Loosening the knob 80 may allow the base 74 to slide along the straight rail 76. A rail foot 82 may stand on the flange of the left rigid track 22 and a second rail foot at the other end of the rail may stand on the flange of the right rigid track 20. When taking measurements in the piano, these feet stand on either end of the keybed lifting the straight rail 76 over any inconsistencies in its flatness. The rail 76 may be mounted on rail extensions 77 on each end of the rail 76. These both stiffen the rail and extend its reach to accommodate the varying widths of different piano's keybeds. The rail feet 82 may support the rail extensions 77, and therefore the rail 76, on the custom bed 10 spanning between the two rigid tracks and supported in the middle by a thumb screw touching down on a leveling block attached to the back rail of the custom keybed.

Figure 13:
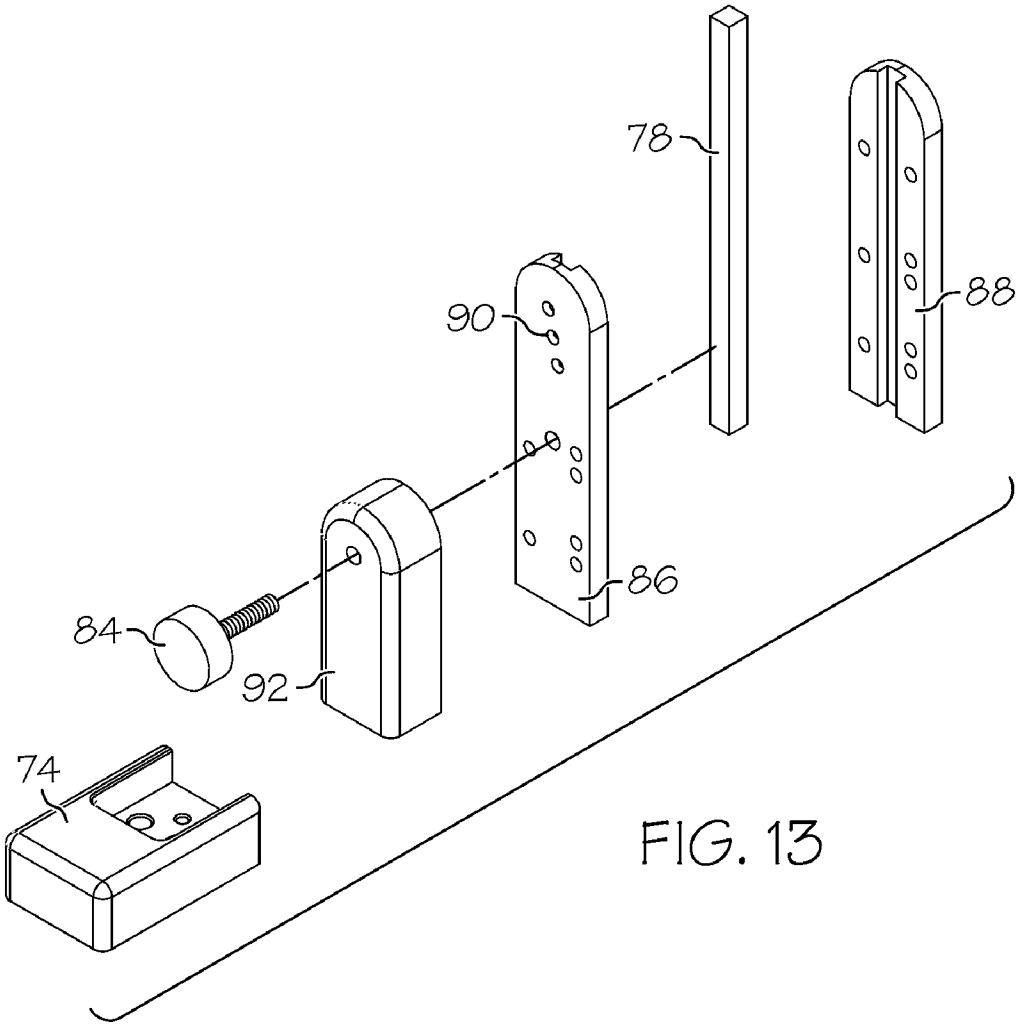
FIG. 13 is an exploded view of a string height gage separated from the string height gage assembly of FIG. 10.
Figure 12:
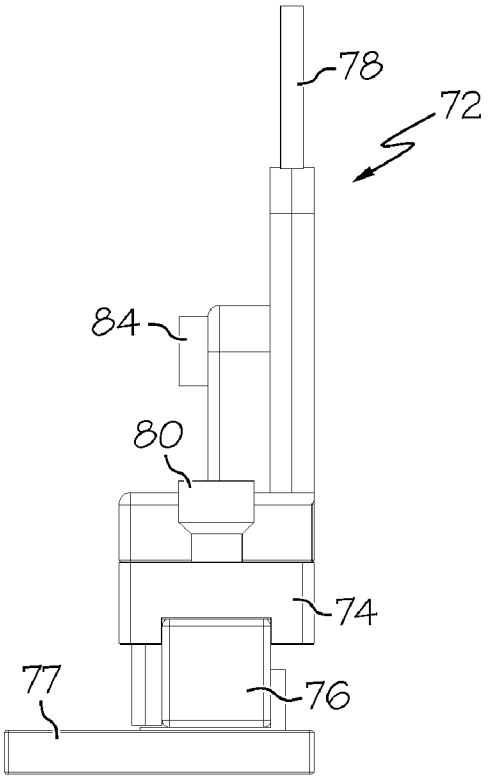
FIG. 12 is a side view of the string height gage assembly of FIG. 10.

The gage 72 may include a toggle thumb screw 84 for securing the height of the plunger 78. As shown in FIG. 13, the plunger 78 may fit between a front plate 86 and a back plate 88 of the gage 72. Registration holes 90 may be formed in the front plate 86, offset from each other to afford as many distinct measurements per side of the plunger as there are registration holes. The toggle thumb screw 84 applies pressure directly to the plunger 78, fixing it against the back plate 88. The plunger 78 may be gently raised to the strings by a compression spring and then marked through a registration hole by a pen, center punch, or other marking device such that this mark, centered in its registration hole, recreates exactly the position of the plunger 78 touching those strings. Thus a permanent record of the height of the strings of a particular note is created on the plunger, and that position may be measured for making a whole action template or recreated in the gage on the sliding base on the custom keybed for accurately setting the template at strike height. The sliding base may have a cursor, which may ride over a scale on the side of the straight rail to indicate the horizontal distance from the action stop it is pressed against to the string whose height is being measured.

The plunger 78 may also be used to level the strings in the piano along the strike line in preparation for final hammer-to-string fitting. Its flat top surface may rise vertically from its straight rail 76 to touch the lowest string or strings of a unison. The low strings can then be lifted so that all of that unison's strings are contacted equally by the tip of the plunger (tested by plucking the strings), indicating that they are parallel to the keybed. This simplifies the final fitting and assures that strings are not over-lifted in the process, a hazard to good tone and to tuning stability. There is currently an electronic device for such leveling, but it has a round plunger, which presents a convex surface to the strike line. Since grand piano strings rise slightly from their termination points and also since that device depends on the surface of the keybed, it will not be as accurate as the regulation station's gage, which references a straight line and which maintains its verticality by being supported by a straight rail suspended between feet at either end over the keybed.

Having described the regulation station and its components, the following describes various uses of the regulation station. The regulation station may be used for a variety of applications, including, but not limited to those described herewithin.

String height measurements, bedding of the keyframe (on its keybed), and precise reproducible samples of keydip (one in front of each balance stud) are prerequisites for setting up the components of the regulation station accurately. Once these measurements have been taken, the action work may proceed on the custom keybed 10 on the benchtop or other understructure independently of the rest of the piano. When the template 40 has been set to strike position with the string height gage 72, template stops 46 may be secured to allow the template to change position and return to strike without needing to be re-measured. Similarly, when the regulating rack 36, holding the template 40 in strike position, has been slid along the rigid tracks 20, 22 so that the crowns of the hammers meet the front edge of the template 40 at strike, stops 38 on the rigid tracks 20, 22 may be secured to allow the regulating rack 36 to slide back out of the way and return without having to be set up again.

Template indicators 48 may make it easy to measure let-off and drop. Moving the template 40 is a process of loosening and retightening the three knobs 44 that hold it to its rail (or loosening and retightening the two knobs 43 to adjust the rail itself). Once the chosen distances for let-off in the treble and bass are set by eye, feel, or gage by adjusting the space between the top of the template 40 and the indicators 48, let-off and drop can be regulated for the whole action. Slots 94 in the template 40 may be cut to provide the exact travel of blow distance, so the hammer line is set up by loosening the knobs 44 and lowering the template 40 all the way down.

The regulating rack 36 may be moved forward so that the template 40, set at strike height, is directly above the hammer shank centers. In this position, the distance between a hammer center and the strings its hammer strikes along the strike line, a distance crucial for boring hammers accurately, may be measured directly with calipers from multiple sample hammer shank centers to their respective string heights as represented by the template. The traditional method involves measuring from the centers of the end shanks to the surface of the benchtop and subtracting these two measurements from string heights taken in the grand piano, each step of which is a variable whose accuracy is hard to verify.

Because the custom keybed 10 may provide true bedding of the action, the keys can be leveled and dipped out on the bench, where squaring, spacing and leveling the keys is much easier. In fact, after the bedding, the key dip sampling, and the making of the template are in place, the entire assembly and regulation can be accomplished remote from the grand piano and then work as expected when reinstalled in the grand piano.

With respect to hammer-to-string fit, the regulating rack 36 and template 40 may show exactly where strike is located. The squaring platform 54 can suspend the hammers in strike position and establish a horizontal plane from which the essential verticals of travel and squaring can easily and quickly be adjusted. If the travel is vertical, the hammer is vertical upon arrival, and the hammer is well-shaped, then the hammer-to-string fitting by adjusting the strings will, in fact, level the strings to the plane of the keybed. This has a by-product of solving another technician's puzzle—voicing for the soft pedal. Because the strings are made parallel to the keybed, the hammer-to-string fit will be maintained at any increment of soft-pedaling, which moves the action sideways on the keybed to change where the hammers strike their strings.

The regulating rack 36 may be portable and weigh less than 15 pounds. It can be quickly taken apart into three pieces. In a small shop, the regulating rack 36 can be hung up by its handle 50 out of the way. For road service, it can be brought along by the technician. Lid mats (not shown) may provide on a piano's lids a stable and non-marring surface on which to set up with stability a portable regulation station.

The various components of the present invention may be used individually or together. For example, the regulating rack 36 may be used with or without the custom keybed 10. The same is true for the squaring platform 54, shank traveler 56, and hammer square 58.

Figure 15:
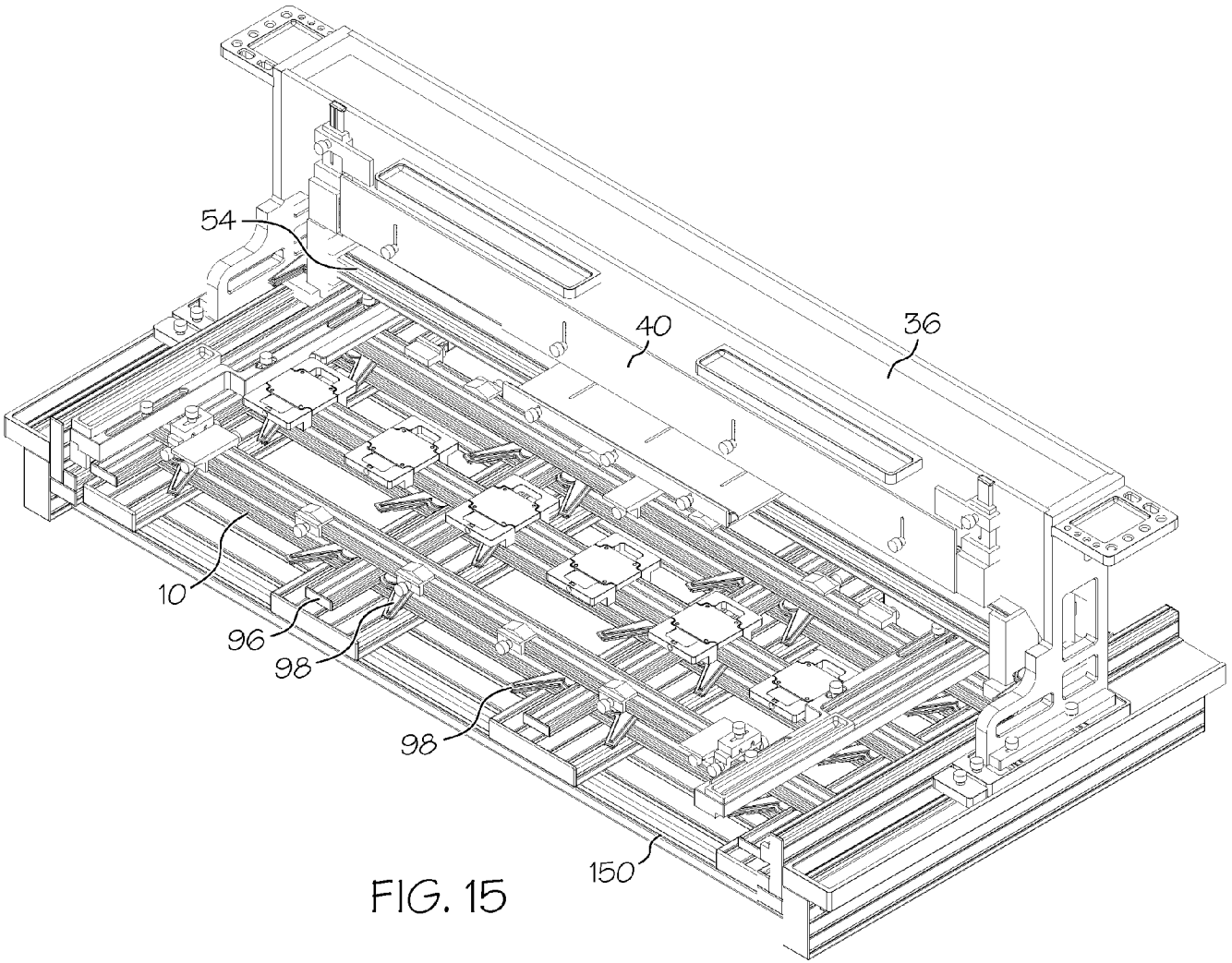
FIG. 15 is a perspective view of a dedicated regulation station according to an embodiment of the present invention.
Figure 16:
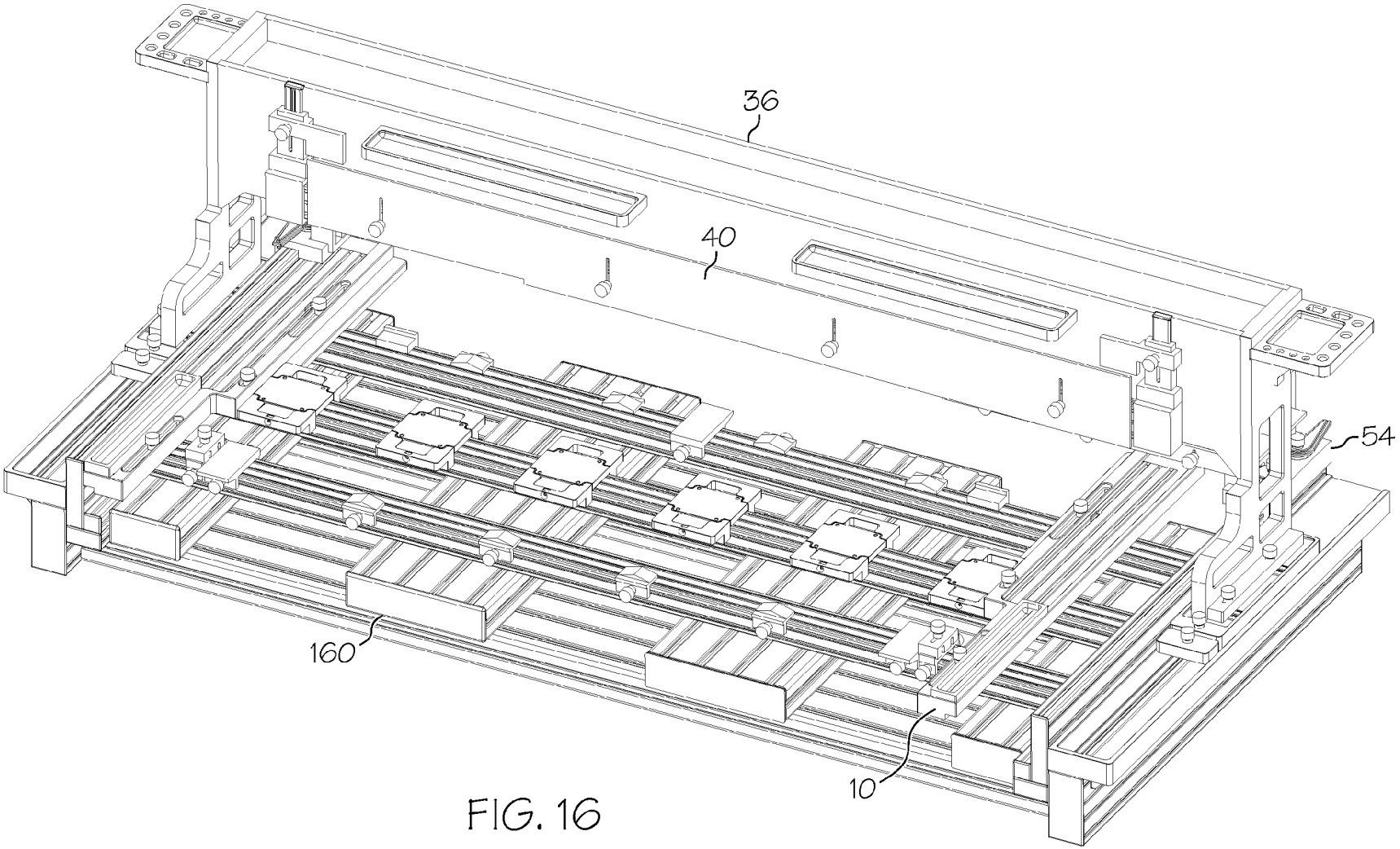
FIG. 16 is a perspective view of another embodiment of a dedicated regulation station.

The present invention may also provide a dedicated regulation station, as shown in FIGS. 15 and 16, which may be more heavy-duty, have a built-in light, a storage shelf for templates, tool holders, and tool trays. The dedicated regulation station may be installed on a standard 72 inch by 36 inch bench. For increased dimensional stability, two models of custom-designed understructures may be used. The first understructure 150 (FIG. 15) may receive, lock in place and release multiple custom keybeds. In this model, the underside of the custom keybed may include runners 96, which may be secured to the understructure by cams 98, instead of individual levelers. The second version of the understructure 160 (FIG. 16) may have certain elements of the custom keybed (such as tracks, bedding blocks, levelers, stops and hold-downs) installed on its own rail structure. Each incoming grand piano action must be fit to the understructure of this design, but the results are extremely stable.

Regardless of whether a portable or dedicated regulation station is used, additional collateral benefits of working on actions in the regulation station have to do with return visits. In a rebuild, there are multiple returns to the steps of assembly and regulation. Because adjusting one thing changes other things, a process of first roughing in, then general adjustment, and finally fine adjustment is necessary for properly accomplishing the job. Squaring affects perception of travel. Traveling affects the squaring. Spacing is affected by both squaring and traveling. Hammer line must be in place to adjust jack position, repetition lever height and spring tension. Changes to spring tension can change the hammer line, jack position, repetition lever height, and so forth. With traditional sampling and let-off rack methods, new samples must be taken each time let-off and drop are to be set—and the samples are hard to take accurately each time. It is quite likely that each round of samples taken with the conventional methods will differ to some degree from the last. With the present invention, once a whole action template 40 is correctly made, two measurements (set up from the gage 72, sliding base 74, and straight rail 76 that initially took those measurements in the piano) may recreate exactly the same set-up in the regulation station, every time, quickly and easily.

When returning to the grand piano at a later date for service, a quick set-up of the whole action template 40 and the squaring platform 54 may make it easy to travel, square, and space first, before touching up the hammer-to-string fit (which will have changed with tuning and playing) by lifting the strings that are low. So, in a relatively short session, an underlying source of voicing changes can be corrected before resorting to needles and additives.

Figure 4:
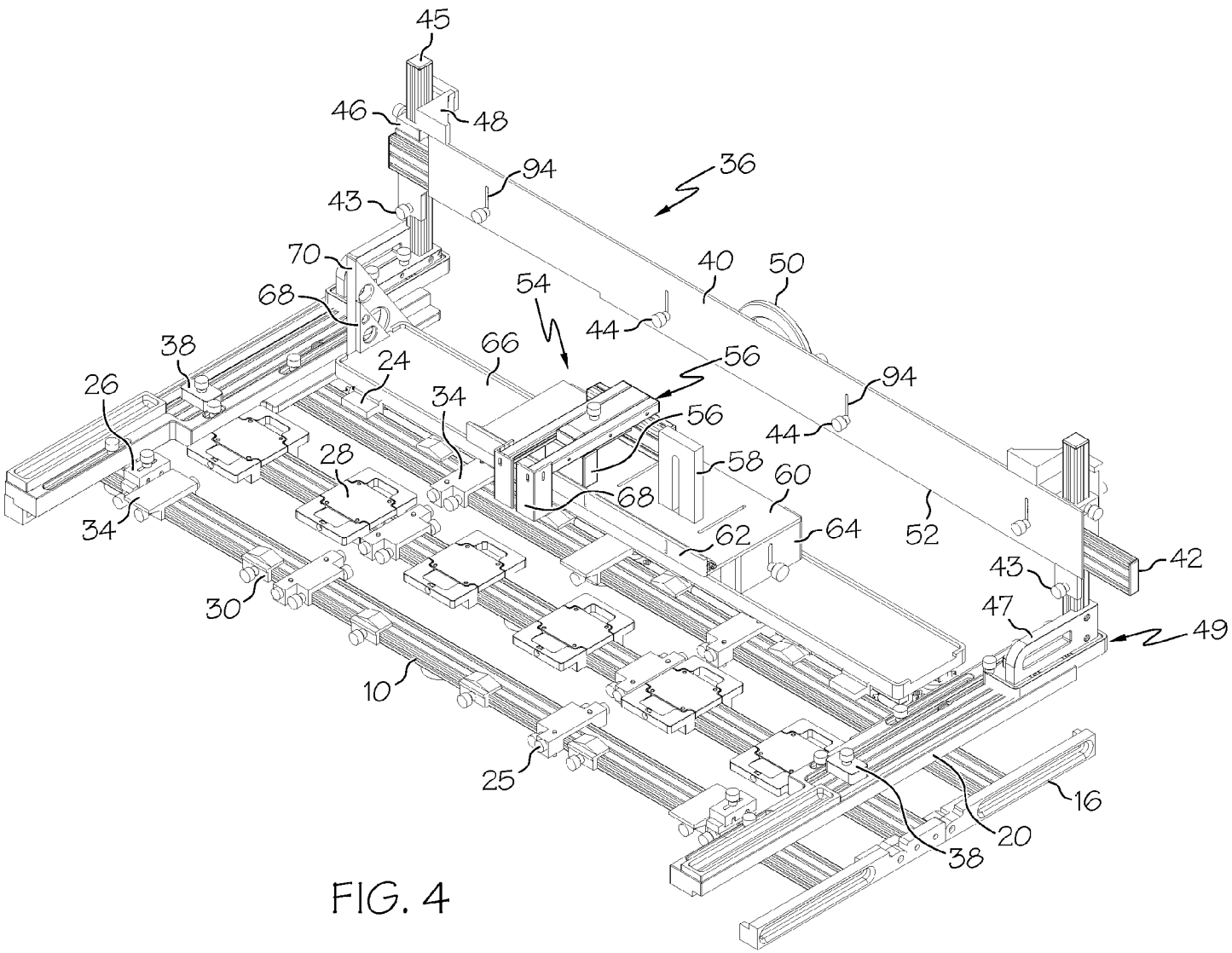
FIG. 4 is a perspective view of a regulating rack mounted on the custom keybed of FIG. 1; this view also includes the squaring platform according to an embodiment of the present invention on its positioning tray, depicted with a grand shank traveler and a hammer square on its sliding top (as do FIGS. 5, 6, and 7)
Figure 5:
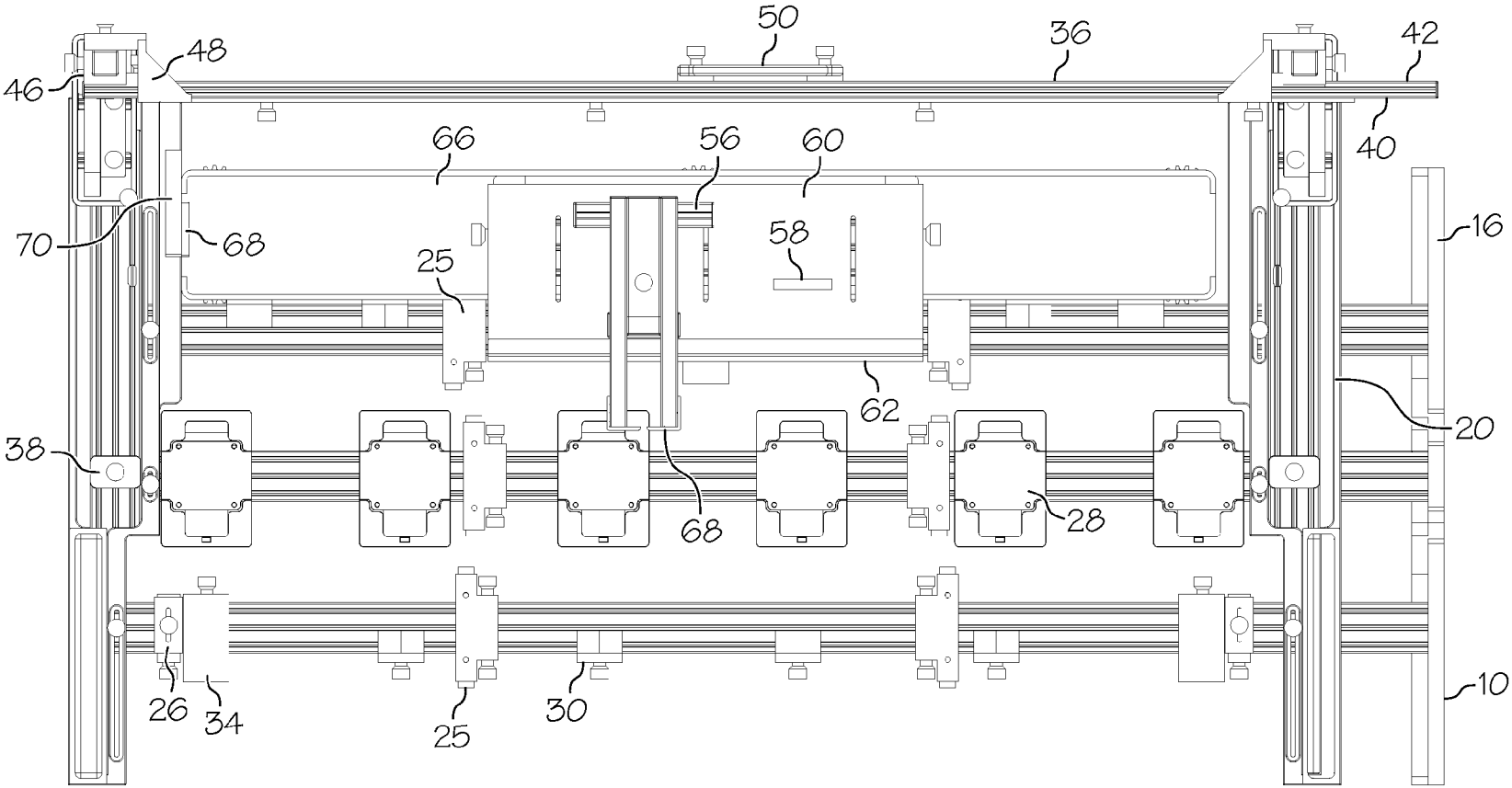
FIG. 5 is a top view of the mounted regulating rack of FIG. 4.
Figure 6:
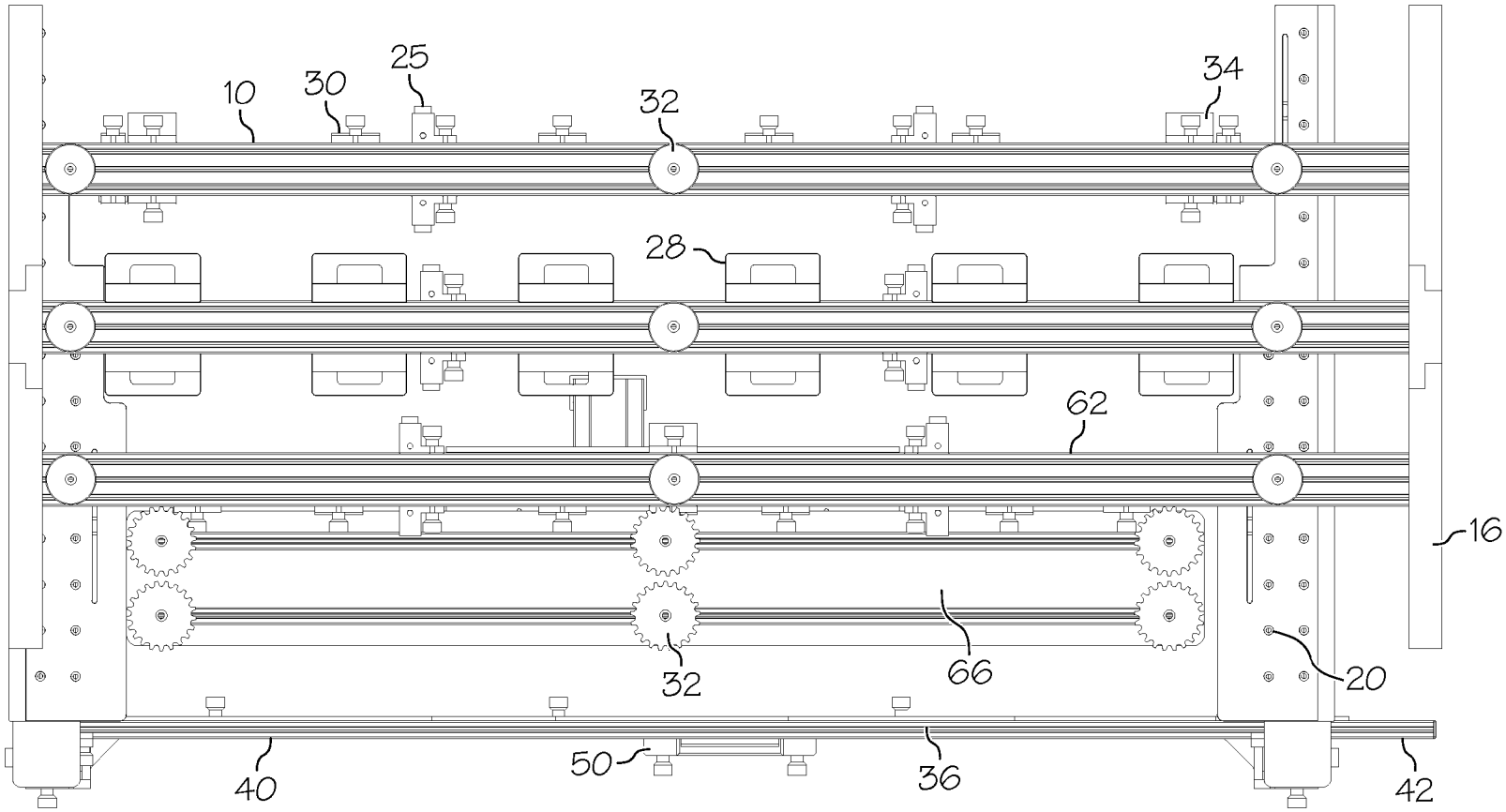
FIG. 6 is a bottom view of the mounted regulating rack of FIG. 4.
Figure 7:
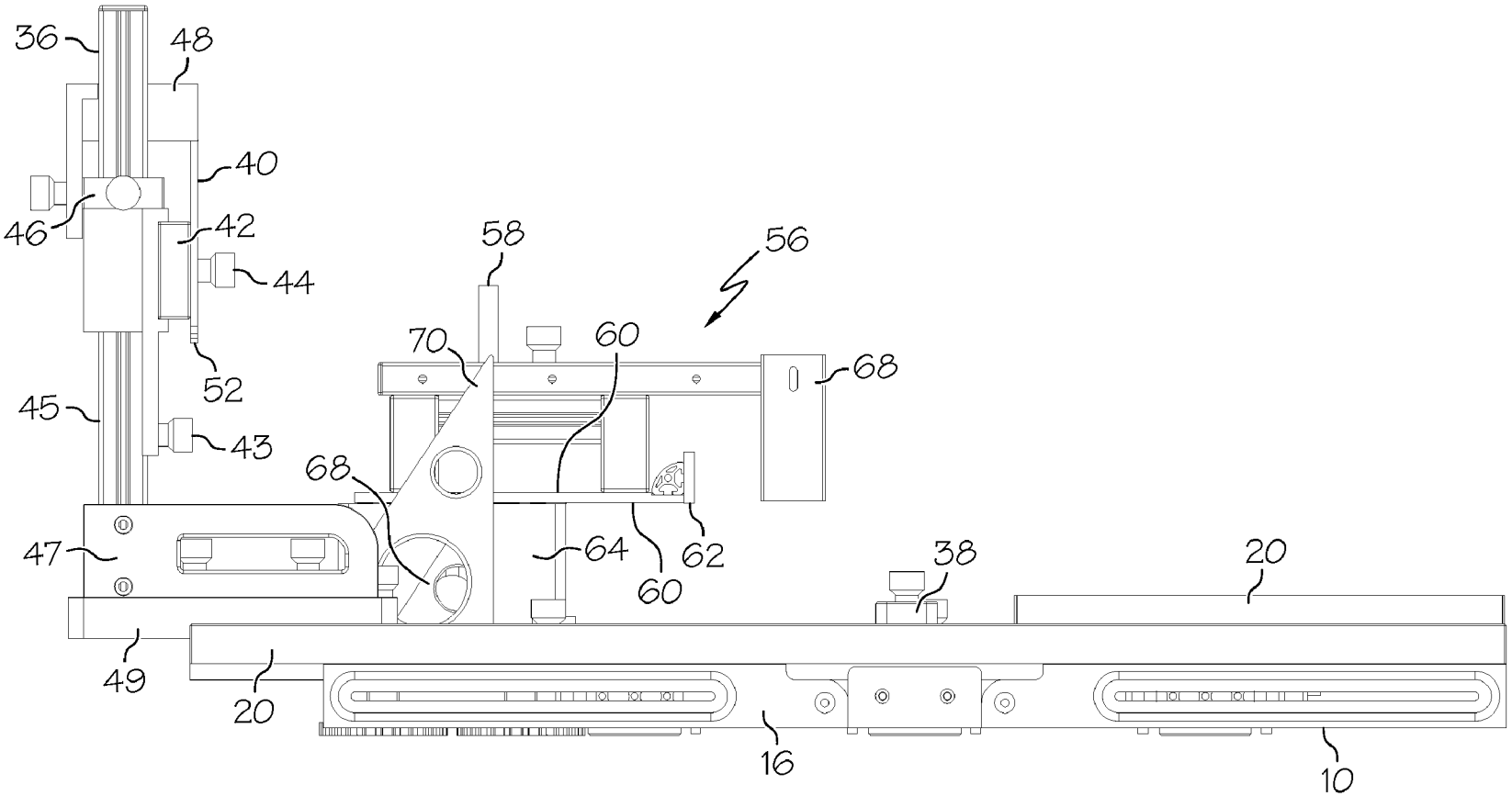
FIG. 7 is a side view of the mounted regulating rack of FIG. 4.

Another benefit of the present invention has to do with filing the hammers. Because hammer lines follow the strings and the strings are often not horizontal along the strike line, gang filing the top two straight-bored sections can easily result in methodically miss-filing all the hammers in those sections. By inverting the whole action template 40 so that the straight upper side is down (inverted from its normal position, for example, as shown in FIG. 4) and setting up this straight line to be horizontal, the hammers supported at this new horizontal "strike" position can be filed correctly and much more accurately than they can be individually. Also, with this inverted template configuration, all the hammers can be inspected for proper filing by comparing their crowns to the straight horizontal edge.

The regulation station may be comprised of four basic components, each of which contributes in conjunction with the others to allowing grand piano actions to be assembled and regulated on a benchtop and then fit back into their pianos exactly as expected. The regulation station may create a stable environment on the benchtop that provides accurate references for setting up all aspects of keys, keyframe, and top-stack of a grand piano action, including the verticality of hammer travel and hammer position at strike. The four components of the regulation station include the following: 1) regulating rack 36 with template 40 (referred to below as "RR"); 2) custom keybed 10 (referred to below as "CK"); 3) squaring platform 54 and squaring platform tray 66 with hammer square 58 and shank traveler 56 (referred to below as "SP"); and 4) string height gage 72 with sliding base 74 and string height gage rail 76 (referred to below as "SHG").

The regulation station may deliver the following features and benefits, wherein the component responsible for this feature and benefit is shown in parenthesis following the feature:

1. A grand piano's string height profile along the strike line in a whole action template, custom matching a particular grand piano since each grand piano is unique, spanning the entire action for quick set-up and efficient work (SHG/RR);

2. String height measurements from the straight line of the string height gage rail, including a horizontal coordinate for each vertical measurement, allowing an accurate whole action template to be made and allowing it (or a segmented template) to be set up accurately over a grand action on a benchtop that does not necessarily match the keybed (SHG);

3. Strike position, let-off, drop, and hammer line provided accurately for a grand action out of the grand piano on a benchtop (RR/SHG/CK);

4. All features available with either a whole action template and a more traditional but less efficient or effective segmented template (RR/SHG);

5. Hammer spacing scale at strike recorded on the profile edge of the template, which matches the hammers at strike, allowing accurate spacing of hammers on the benchtop needed each time a hammer is reinstalled, traveled, or squared (RR/SHG/CK/SP);

6. Accurate hammer surface reference at strike on benchtop (RR/SHG/CK/SP);

7. Accurate string leveling in the grand piano along the strike line, preparing strings to fit with the hammer surfaces in the fine hammer-to-string fitting (SHG);

8. Relationships between the grand action and its strings, the keybed, and the action stop replicated and stably maintained out of the grand piano on the benchtop (or other under-structure) such that the results of adjustments made work the same on the benchtop or in the grand piano (RR/SHG/CK);

9. Specify the exact location of strike compared to a grand action on the benchtop (RR/SHG);

10. Specify the same support on the benchtop to the grand keyframe and, thereby, its action that its keybed in the grand piano provides (CK);

11. More specific replication on the benchtop of the front rail fit of a Steinway® keyframe held down under tension over the crowned front rail of its keybed (CK);

12. Provides, on the benchtop, keyframe support for one action until its done in a portable custom-fitting structure, for one of multiple actions using one regulation station in a rigid, cam-clamping-in-and-out structure, or for super-stable, quick set-up one action at a time in an integrated-with-the-benchtop structure (CK);

13. Reference of vertical relative to the plane of the keybed (horizontal plane of the action) for making hammers vertical at strike, for making hammer travel vertical, and for confirming strike surface of hammers as horizontal (parallel to keybed) (RR/CK/SHG/SP);

14. Specifically straight-bored hammers at a strike position modified to be parallel to the keybed (the inverted whole action template or the segmented template set up to be horizontal to the plane of the action), travelling vertically and positioned vertically for gang-filing to have perfectly horizontal strike surfaces and evenly tapered profiles (front-to-back) one to the next to the next (RR/CK/SHG/SP);

15. Specifically no over-lifting of strings in string leveling (which would create tonal problems and instability while trying to accomplish the opposite) by pre-leveling strings (SHG) and making hammers arrive at strings vertically, vertical, and with horizontal strike surfaces leaving only the finest lifting for final hammer-to-string fitting during the final tunings (RR/CK/SHG/SP);

16. Specifically horizontally leveled strings that provide a properly functioning soft pedal system, the hammers maintaining their hammer-to-string fit at all stages of soft-pedaling because the action moves horizontally under horizontal strings at the strike line with horizontal surfaces of the hammers as they strike the strings (RR/CK/SHG/SP); and 17. Specifically allows visually impaired technicians advantages over other tools and techniques for assembling and regulating grand pianos employing tactile and aural strategies with superior references, stability, and functionality (RR/CK/SHG/SP).

These features may produce improvements of tone, power, and repetition by bringing the mechanics of the action into compliance with verticality, its strongest and most efficient disposition. By simplifying the processes of assembly and regulation, speeding up set-up and break-down times, offering easy to read and use references, making measuring and adjusting more accurate and faster, and by providing permanent records in templates, set-up measurements, and SHG plungers, time is saved using the regulation station and more profit is made.

These same virtues make grand piano action work more accurate, more predictable, and remove obstacles from achieving best results. Although the regulation station is new, it functions to allow piano technicians to do what they already know how to do more effectively, removing headaches and variables that sap energy and waste resources. This benchtop work environment can be accessed from all sides, can be height-adjusted for best ergonomics, and can receive excellent general and focused lighting. Once the string height measurements have been taken and a template made, that template can set up for a grand action exactly the same every time. The traditional setting of samples for let-off in the grand piano, for instance, was exceedingly hard to do accurately because of strings, dampers, and plate struts in the way, awkward sight angles, and poor lighting. And each time let-off needed to be adjusted, the frustrating process of setting samples would ensue again. Traditional string height gages employed plungers that were not permanently marked and might well change slightly in the process of being removed from under the strings for measuring. Their plungers were often round, making accurate measuring of the slightly rising strings of a grand piano tend to be imprecise. Also, they depended on the flatness of the keybed and the benchtop to accurately indicate the string height on the benchtop. In the regulation station, according to embodiments of the present invention, an edge of the square plunger can readily find and conform to the strike line, providing exact measurements recorded with a dimple or a dot of permanent ink easily re-centered in its registration hole out of the piano to assure accurate positioning of that plunger for measuring or for setting up either a whole action or segmented template. The improved access, stability, and methodical logic of working with the regulation station particularly help level the playing field for the visually impaired.

Modern computer-aided design and manufacturing capabilities, coupled with superior hardware including extremely accurate aluminum extrusions, allow the intricate parts of the regulation station to be made precisely enough to really work. Formerly, such accuracy and the ability to reproduce it cost-effectively were out of reasonable reach. A skilled technician with normal shop materials, tools, and techniques could not economically produce such jigs so that they would be accurate enough to be useful. The industry accepted work-around approximations of specifications because the available means of referencing were awkward and imprecise. The cost of the regulation station can be made back quickly with increased efficiencies and reduced work time.

While the above description refers to tools, concepts and strategies for work on grand pianos, the concepts and strategies of the present invention may be applied to tools for upright pianos as well.

It should be understood, of course, that the foregoing relates to exemplary embodiments of the invention and that modifications may be made without departing from the spirit and scope of the invention as set forth in the following claims.

What is claimed is:

1. A regulation station for a grand piano action, comprising:

a regulating rack having:

a first regulating rack leg slidably attached to a first rigid track; and a second regulating rack leg slidably attached to a second rigid track, wherein a template adapted to span between the first regulating rack leg and the second regulating rack leg, the template providing a representation of the strings of a grand piano along the strike line and further comprising a string height gage having a plunger, movable along a straight rail, to measure string heights of a grand piano.

2. The regulation station of claim 1, further comprising a template rail spanning between the first regulating rack leg and the second regulating rack leg, wherein the template is adjustably secured to the template rail and the template rail is adjustably secured to the first and second regulating rack legs.

3. The regulation station of claim 1, wherein the template is a whole action template.

4. A regulation station for a grand piano action, comprising:

a regulating rack having:

a first regulating rack leg slidably attached to a first rigid track; and a second regulating rack leg slidably attached to a second rigid track, wherein a template adapted to span between the first regulating rack leg and the second regulating rack leg, the template providing a representation of the strings of a grand piano along the strike line and further comprising a string height gage having a plunger, movable along a straight rail, to measure string heights of a grand piano, wherein, upon the plunger can be permanently recorded sample string height measurements for a specific grand piano.

5. The regulation station of claim 4, wherein the straight rail is adapted to be positioned on a keybed of a grand piano so that an edge of the plunger follows the strike line of the grand piano action.

6. A regulation station for a grand piano action, comprising:

a regulating rack having:

a first regulating rack leg slidably attached to a first rigid track; and a second regulating rack leg slidably attached to a second rigid track, wherein a template adapted to span between the first regulating rack leg and the second regulating rack leg, the template providing a representation of the strings of a grand piano along the strike line and further comprising a custom keybed adapted to support the grand piano action outside of a grand piano.

7. The regulation station of claim 6, wherein the custom keybed is adapted to support the regulating rack.

8. The regulation station of claim 6, wherein the custom keybed includes bedding blocks for supporting the grand piano action.

9. The regulation station of claim 8, wherein the custom keybed includes two keyframe holddowns for securing the grand piano action.

10. The regulation station of claim 6, wherein the custom keybed is portable.

11. The regulation station of claim 6, wherein the custom keybed is adapted to be secured to a benchtop.

12. A regulation station for a grand piano action, comprising:

a regulating rack having:

a first regulating rack leg slidably attached to a first rigid track; and a second regulating rack leg slidably attached to a second rigid track, wherein a template adapted to span between the first regulating rack leg and the second regulating rack leg, the template providing a representation of the strings of a grand piano along the strike line and further comprising a squaring platform, the squaring platform including:

a squaring platform tray spanning in between the first and second rigid tracks in a portable regulation station;

a sliding top slidable along the squaring platform;

a hammer square on the sliding top; and a shank traveler on the sliding top.

* * * * *